US006467572B1

(12) United States Patent
Liu

(10) Patent No.: US 6,467,572 B1
(45) Date of Patent: Oct. 22, 2002

(54) MUFFLER

(76) Inventor: Jefferson Liu, No. 13-8, Shuiching Lane, Shuiching, Peitun, Taichung (TW)

( * ) Notice: Subject to any disclaimer, the term of this patent is extended or adjusted under 35 U.S.C. 154(b) by 118 days.

(21) Appl. No.: 09/639,318

(22) Filed: Aug. 15, 2000

(51) Int. Cl.[7] ..... F01N 1/08
(52) U.S. Cl. ..... 181/272; 181/275
(58) Field of Search ..... 181/272, 275, 181/264, 268

(56) References Cited

U.S. PATENT DOCUMENTS 4,030,651 A * 6/1977 Weiss et al. ..... 181/264
4,222,456 A * 9/1980 Kasper ..... 181/238
4,296,832 A * 10/1981 Kicinski ..... 181/255
4,589,515 A * 5/1986 Omura ..... 181/227
4,782,912 A * 11/1988 Wandless ..... 181/229
6,050,363 A * 4/2000 Tu ..... 181/264

* cited by examiner

*Primary Examiner*—Robert E. Nappi
*Assistant Examiner*—Kim Lockett
(74) *Attorney, Agent, or Firm*—Pro-Techtor International Services

(57) ABSTRACT

A muffler has an outer tube and an inner tube sealingly received in the outer tube. The inner tube has multiple shrink throats securely arranged therein and multiple through holes peripherally defined therein. Multiple baffles are formed between the outer tube and the inner tube and each of which has multiple openings. Every time when the exhaust air passes through the shrink throat in the inner tube, the speed of the exhaust air increases. Eventually, the efficiency of discharging the exhaust function increases. Due to the shrink throats, the backpressure from the exhaust air increasing, therefore hinders the power loss due to the early opening of the exhaust valve in the power (expansion) stroke.

3 Claims, 3 Drawing Sheets

MUFFLER

BACKGROUND OF THE INVENTION

1. Field of the Invention

The present invention relates to a muffler, and more particular to a muffler having an outer tube and an inner tube securely mounted inside the outer tube. The inner tube has multiple through holes defined in a periphery thereof and multiple shrink throats formed therein. Multiple baffles are provided between the outer tube and inner tube and each having multiple holes defined to communicate with spaces defined by the baffles. When the engine is in operation, the discontinuous discharge exhaust air from the engine will fill in the spaces and therefore generates a backpressure, which increases the resistance to the discharge of the exhaust. Before the piston of the engine is reaching the bottom dead center, said backpressure can reduce the power loss due to the early opening of the exhaust valve in the power (expansion) stroke. When the exhaust air passes the shrink throats, the speed of the exhaust air is increased (by the Venturi Tube Theory, $P_1V_1=P_2V_2$). After the exhaust air passes through the first shrink throat, because of the increase in the speed of the exhaust air, the air in the first space is sucked in, therefore builds up a pressure before the second shrink throat. As said process goes on, the exhaust function is discharged thoroughly.

2. Prior Art Description

Generally speaking, there are four different strokes in an engine when generating power: intake, compression, expansion and exhaust. When the piston of the engine is moving from the bottom dead center (BDC) to a top dead center (TDC), the engine is processing either the compression stroke or the exhaust stroke. When the piston is moving nearly to the TDC, the intake valve and exhaust valve are closed to start the expansion stroke. The sudden pressure generated by the explosion caused by the sparking plug will push the piston back to the BDC to be ready for the next stroke, the exhaust stroke. However, in order to discharge the exhaust function from the expansion stroke, the exhaust valve will be opening before the piston reaches the BDC. The early opening of the exhaust valve will cause a loss to a portion of the power generated from the expansion stroke. To avoid such situation, the exhaust valve should be opening as late as possible. However, another problem arises should the exhaust valve be opening too late. That is, if the exhaust valve be opening too late, the exhaust function from the expansion stroke will not be able to discharge thoroughly, which will hinder the exhaust stroke to process properly. Consequently, the entire exhaust stroke procedure will be influenced seriously. This dilemma troubles engine designers.

It is an objective of the invention to provide an improved muffler to obviate and mitigate the aforementioned problems.

SUMMARY OF THE INVENTION

The primary objective of the invention is to provide an improved muffler to provide a sufficient backpressure to reduce the power loss in the expansion stroke.

Another objective of the invention is to increase the speed of the exhaust air to reach the requirement of discharging the exhaust function thoroughly in the exhaust stroke.

Other objects, advantages and novel features of the invention will become more apparent from the following detailed description when taken in conjunction with the accompanying drawings.

DETAILED DESCRIPTION TO THE PREFERRED EMBODIMENT

Figure 1:
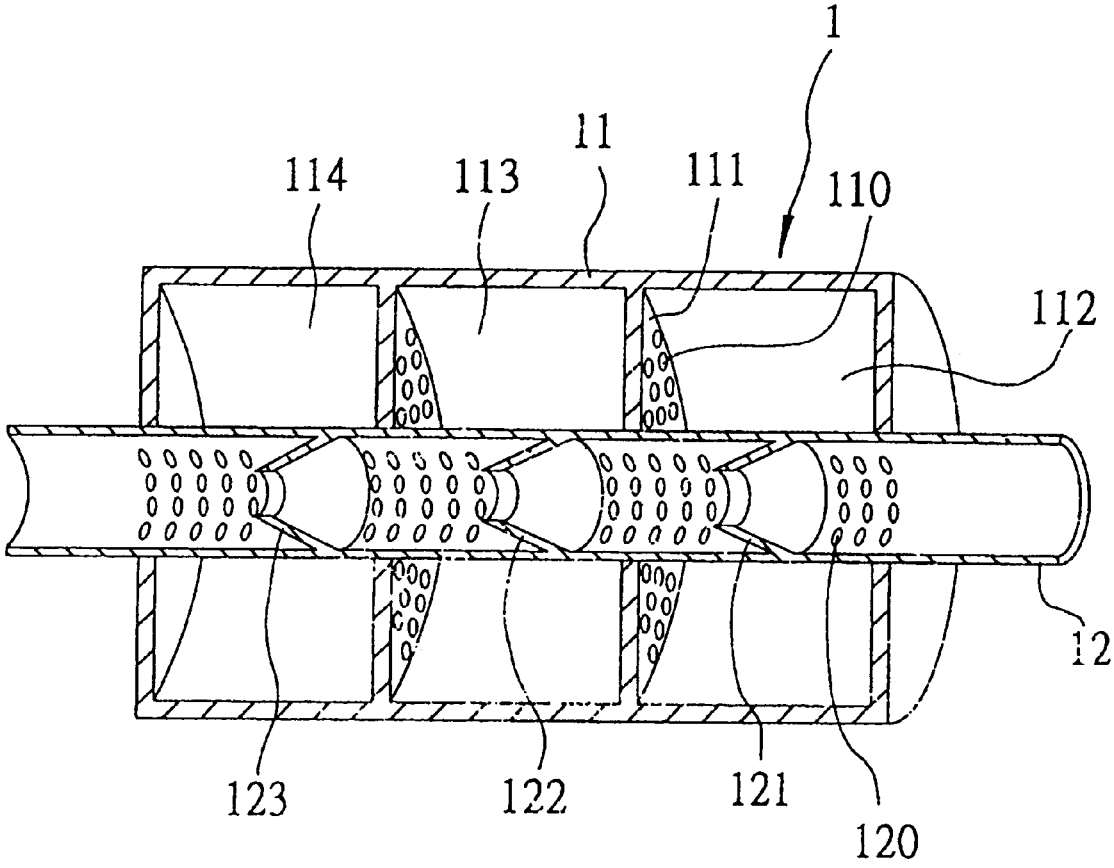
FIG. 1 is a cross sectional view of the muffler constructed in accordance with the present invention.

With reference to FIG. 1, a muffler (1) of the invention has an outer tube (11) and an inner tube (12) longitudinally received and confined inside the outer tube (11). The outer tube (11) is mounted outside the inner tube (12) in an air-tight manner. The inner tube (12) has two open ends (not numbered or shown) and one of which is connected with the engine and the other one of the open end communicates with the ambient air.

The inner tube (12) has multiple peripherally defined through holes (120) and multiple shrink throats (three are shown in this preferred embodiment of the invention) (121, 122, 123) each spaced with the other for a predetermined distance. The inner section area of the first shrink throat (121) is the largest of the three and the third shrink throat (123) is the least of the three.

Multiple baffles (111) are set between the inner periphery of the outer tube (11) and the outer periphery of the inner tube (12), such that multiple spaces (three are shown in this preferred embodiment of the invention) (112,113,114) are defined between baffles (111). Each of the baffles (111) is defined between two adjacent shrink throats; for example the first shrink throat (121) and the second shrink throat (122).

Figure 2:
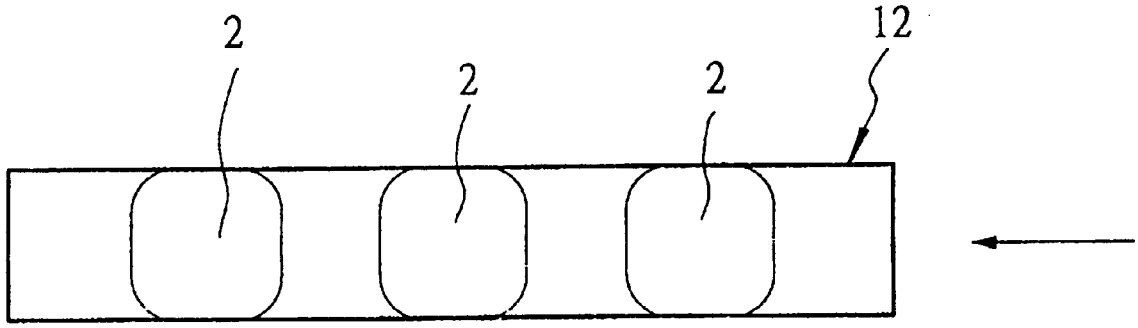
FIG. 2 is a schematic view showing the operation of the exhaust air in the inner tube of the muffler of the invention.
Figure 3:
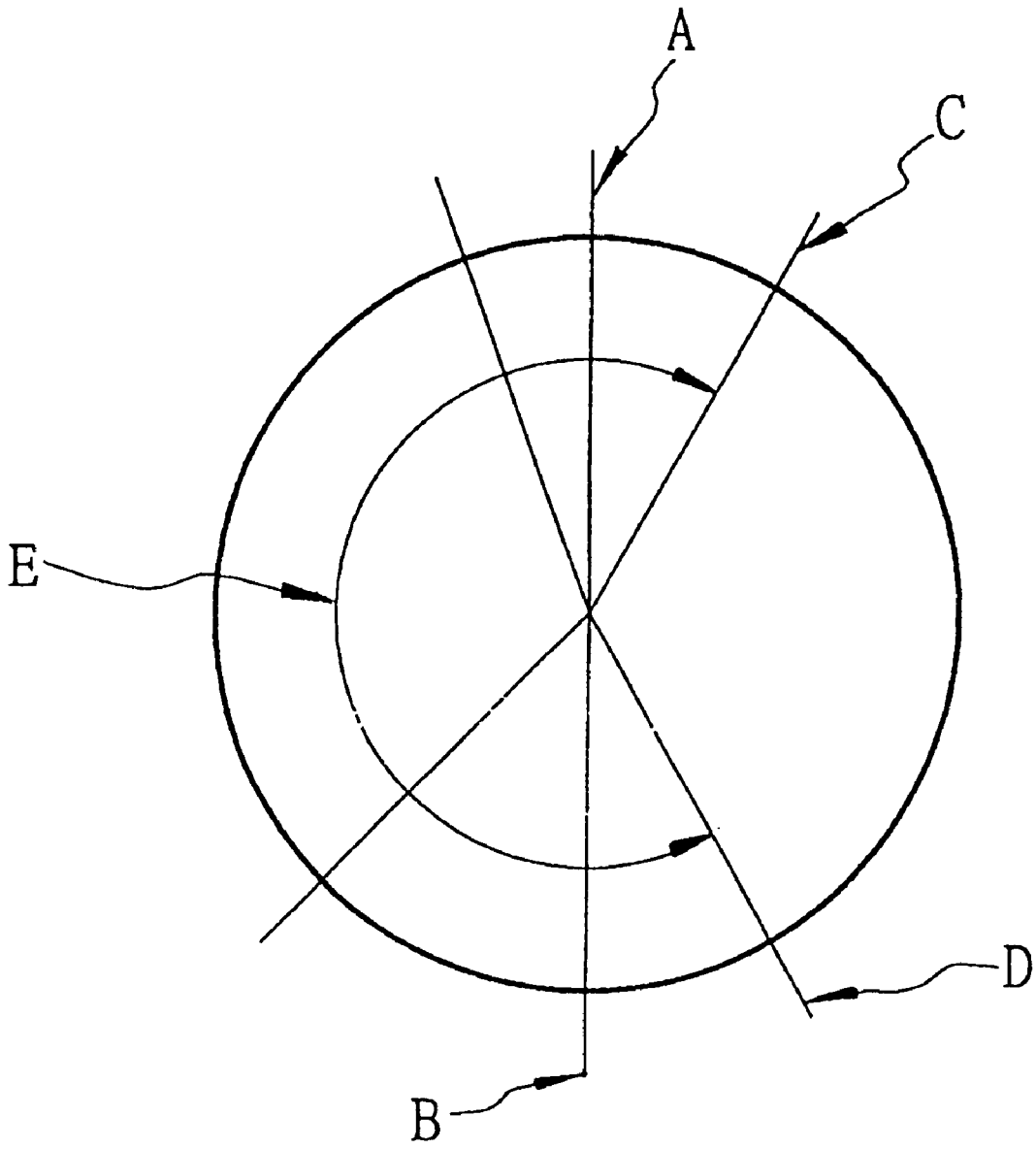
FIG. 3 is a valve timing diagram of the four-stroke engine.

When the engine is in operation, referring to FIG. 2, within seconds, the discontinuous discharged exhaust air from the engine will fill in the spaces (112,113,114) and therefore builds a pressure in each of the spaces (112,113, 114). Before the engine continues to operate and the piston of the engine is reaching the BDC (B of FIG. 3), the exhaust valve starts to open (D of FIG. 3) to proceed to the exhaust function (E of FIG. 3). The discharged exhaust air (2) (2 of FIG. 2), when reaching the inner tube (12), generates a backpressure due to the pressure in the spaces (112,113,114) and the first shrink throat (121), which increases the resistance to the discharging of the exhaust air (2) (2 of FIG. 2) and picks up its speed in the meantime. However, when the exhaust air (2) continues to proceed to the second shrink throat (122), the exhaust air (2) again picks up its speed. After the exhaust air (2) passes the second shrink throat (122) and moves toward the third shrink throat (123), the speed of the exhaust air (2) is once again increased. This phenomena can be explained by the $P_1V_1=P_2V_2$ (Venturi Tube Theory). After times of increasing the speed, the exhaust air (2) is discharged quickly.

When the piston reaches the TDC (A of FIG. 3) and the exhaust valve closes (C of FIG. 3), the pressure in the inner tube (12) vanishes quickly, which generates a radial suction to the air in the spaces (112,113,114) through the through holes (120). The radial suction balances the pressure in the inner tube (12), which provides a resistance to the following exhaust from the exhaust stroke so as to reduce the power loss.

With the arrangement, when the exhaust air (2) passes the first shrink throat (121), its speed increases. Because of the increase in the speed of the exhaust, the air in the first space (112) is sucked in, which builds up a pressure before the second shrink throat (122) to further hinder the power loss. After the exhaust air passes the second shrink throat (122), the air in the second space (113) is sucked in, which builds up a pressure before the third shrink throat (123). Due to the pressure before the third shrink throat (123), the speed of the exhaust air (2) increases again, which increases the discharging of the exhaust.

It can be concluded that the muffler of the invention is able to decrease the power loss from the expansion stroke and increase the efficiency of the discharging of the exhaust from the exhaust stroke.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A muffler comprising:

an outer tube;

an inner tube sealingly surrounded by and extended out from the outer tube and having multiple shrink throats securely formed therein and multiple through holes peripherally defined therein; and multiple baffles each formed between an inner periphery of the outer tube and an outer periphery of the inner tube and having multiple openings defined therein, wherein a plurality of spaces are defined between the outer tube and the inner tube and each communicates with the multiple through holes of the inner tube;

whereby the exhaust air increases its speed after passing through each of the shrink throats in the inner tube so as to increase the efficiency of discharging the exhaust function.

2. The muffler as claimed in claim 1, wherein the inner tube has two open ends, one of which is adapted to connect to the engine and the other one to communicate with ambient air.

3. The muffler as claimed in claim 2, wherein the shrink throats are configured to have different section areas and are sequentially arranged from the largest one to the smallest one in the inner tube in a descending manner.

* * * * *